US009956695B2

(12) United States Patent
Chung et al.

(10) Patent No.: US 9,956,695 B2
(45) Date of Patent: May 1, 2018

(54) SPRING BACK SAFETY AND FILM CUTTER

(71) Applicant: Pacific Handy Cutter, Inc., Irvine, CA (US)

(72) Inventors: Yen-Chao Chung, Taipei (TW); Joseph P. Garavaglia, Newport Beach, CA (US); Glen Kanemoto, Costa Mesa, CA (US); Markus Gropl, Huntington Beach, CA (US); Dave Puglisi, Fountain Valley, CA (US); Mark Marinovich, Rancho Santa Fe, CA (US)

(73) Assignee: PACIFIC HANDY CUTTER, INC., Irvine, CA (US)

( * ) Notice: Subject to any disclaimer, the term of this patent is extended or adjusted under 35 U.S.C. 154(b) by 44 days.

(21) Appl. No.: 14/474,270

(22) Filed: Sep. 1, 2014

(65) Prior Publication Data

US 2015/0202781 A1 Jul. 23, 2015

Related U.S. Application Data

(63) Continuation of application No. 13/310,732, filed on Dec. 3, 2011, now Pat. No. 8,819,942, which is a continuation of application No. 12/111,847, filed on Apr. 29, 2008, now Pat. No. 8,069,571.

(51) Int. Cl.

| | |
|---|---|
| ***B26B 1/08*** | (2006.01) |
| ***B26B 5/00*** | (2006.01) |
| ***B26B 29/02*** | (2006.01) |
| ***B26B 11/00*** | (2006.01) |

(52) U.S. Cl.
CPC ..... *B26B 1/08* (2013.01); *B26B 5/00* (2013.01); *B26B 5/003* (2013.01); *B26B 11/00* (2013.01); *B26B 29/02* (2013.01); *Y10T 83/2168* (2015.04)

(58) Field of Classification Search
CPC ..... B26B 11/00; B26B 1/08; B26B 29/02; B26B 5/00; B26B 5/003
See application file for complete search history.

(56) References Cited

U.S. PATENT DOCUMENTS

| | | | | |
|---|---|---|---|---|
| 4,283,805 A * | 8/1981 | Stacy | B25F 1/00 7/127 |
| 5,023,996 A | 6/1991 | Pape et al. | |
| 5,207,696 A | 5/1993 | Matwijcow | |
| 5,230,152 A | 7/1993 | Kennedy | |
| 5,251,379 A * | 10/1993 | Kuo | B26B 5/001 30/289 |
| 5,303,474 A * | 4/1994 | Keklak | B26B 5/003 30/125 |
| 5,313,376 A | 5/1994 | McIntosh | |

(Continued)

FOREIGN PATENT DOCUMENTS

WO WO-2005/090012 A1 9/2005

*Primary Examiner* — Stephen Choi
(74) *Attorney, Agent, or Firm* — Henricks, Slavin & Holmes LLP

(57) ABSTRACT

A cutter apparatus includes a housing shaped to be hand-held, a slider configured to support a front blade, the slider being mechanically coupled to the housing and configured to be moved longitudinally along the housing, and a blade guard mechanically coupled to the housing and configured to be extended and retracted adjacent to the front end of the housing, wherein the slider and the blade guard are configured to move in tandem.

22 Claims, 14 Drawing Sheets

(56) References Cited

U.S. PATENT DOCUMENTS

| | | | | |
|---|---|---|---|---|
| 5,386,632 | A | 2/1995 | Schmidt | |
| 5,513,405 | A | 5/1996 | Bradbury et al. | |
| 5,613,300 | A | 3/1997 | Schmidt | |
| 5,890,290 | A * | 4/1999 | Davis | B26B 5/003 30/162 |
| 5,890,294 | A | 4/1999 | Keklak et al. | |
| 5,964,132 | A | 10/1999 | Chen | |
| 6,286,745 | B1 | 9/2001 | Ackeret | |
| 6,357,120 | B1 | 3/2002 | Khachatoorian et al. | |
| 6,389,625 | B1 | 5/2002 | Rivera | |
| 6,415,514 | B1 | 7/2002 | Chun | |
| 6,708,410 | B2 | 3/2004 | Okada | |
| 7,131,204 | B2 | 11/2006 | Brown et al. | |
| 7,305,770 | B2 | 12/2007 | Critelli et al. | |
| 7,340,836 | B2 | 3/2008 | Whitemiller et al. | |
| 7,356,928 | B2 | 4/2008 | Votolato | |
| 7,509,742 | B2 | 3/2009 | Votolato | |
| 7,591,072 | B2 | 9/2009 | Stravitz | |
| 7,603,779 | B2 | 10/2009 | Rowlay | |
| 7,784,189 | B2 | 8/2010 | Polei | |
| 7,987,602 | B2 | 8/2011 | Kanemoto et al. | |
| 8,069,571 | B2 | 12/2011 | Chung et al. | |
| 8,819,942 | B2 | 9/2014 | Chung et al. | |
| 2004/0231162 | A1* | 11/2004 | Johnson | B26B 5/001 30/125 |
| 2005/0193568 | A1* | 9/2005 | Peyrot | B26B 5/001 30/162 |
| 2006/0080842 | A1 | 4/2006 | Schmidt | |
| 2008/0086895 | A1* | 4/2008 | Parks | B26B 5/001 30/156 |
| 2008/0110027 | A1 | 5/2008 | Seber et al. | |
| 2008/0163493 | A1 | 7/2008 | Votolato | |
| 2009/0094840 | A1* | 4/2009 | Kanemoto | B26B 5/001 30/162 |
| 2009/0151168 | A1* | 6/2009 | Dadam | B26B 5/001 30/146 |

* cited by examiner

SPRING BACK SAFETY AND FILM CUTTER

CROSS-REFERENCE TO RELATED APPLICATIONS

This application is a continuation of U.S. Utility patent application Ser. No. 13/310,732, entitled "Spring Back Safety and Film Cutter", filed on Dec. 3, 2011 (now U.S. Pat. No. 8,819,942, issued on Sep. 2, 2014), which is a continuation of U.S. Utility patent application Ser. No. 12/111,847, entitled "Spring Back Safety and Film Cutter", filed on Apr. 29, 2008 (now U.S. Pat. No. 8,069,571, issued on Dec. 6, 2011), which are hereby incorporated by reference.

TECHNICAL FIELD

The present invention relates generally to safety cutters and, in particular, cutter apparatuses that safely and comfortably provide multifunctional capability.

BACKGROUND ART

Utility knives with extendable blades are known. Utility knives with blades that automatically retract into a handle are also known. However, such utility knives are often cumbersome or unwieldy, or suffer from deficiencies in the mechanism that is used to extend the blade. Accordingly, it would be useful to be able to provide cutter apparatuses that facilitate easy, safe and comfortable blade extension, as well as user-selectable blade extension lengths. It would also be useful to be able to incorporate the aforementioned features into multifunctional cutter apparatuses.

SUMMARY OF THE INVENTION

In an example embodiment, a cutter apparatus includes a housing shaped to be hand-held, a slider configured to support a front blade, the slider being mechanically coupled to the housing and configured to be moved longitudinally along the housing, and a blade guard mechanically coupled to the housing and configured to be extended and retracted adjacent to the front end of the housing, wherein the slider and the blade guard are configured to move in tandem.

DISCLOSURE OF INVENTION

Figure 1:
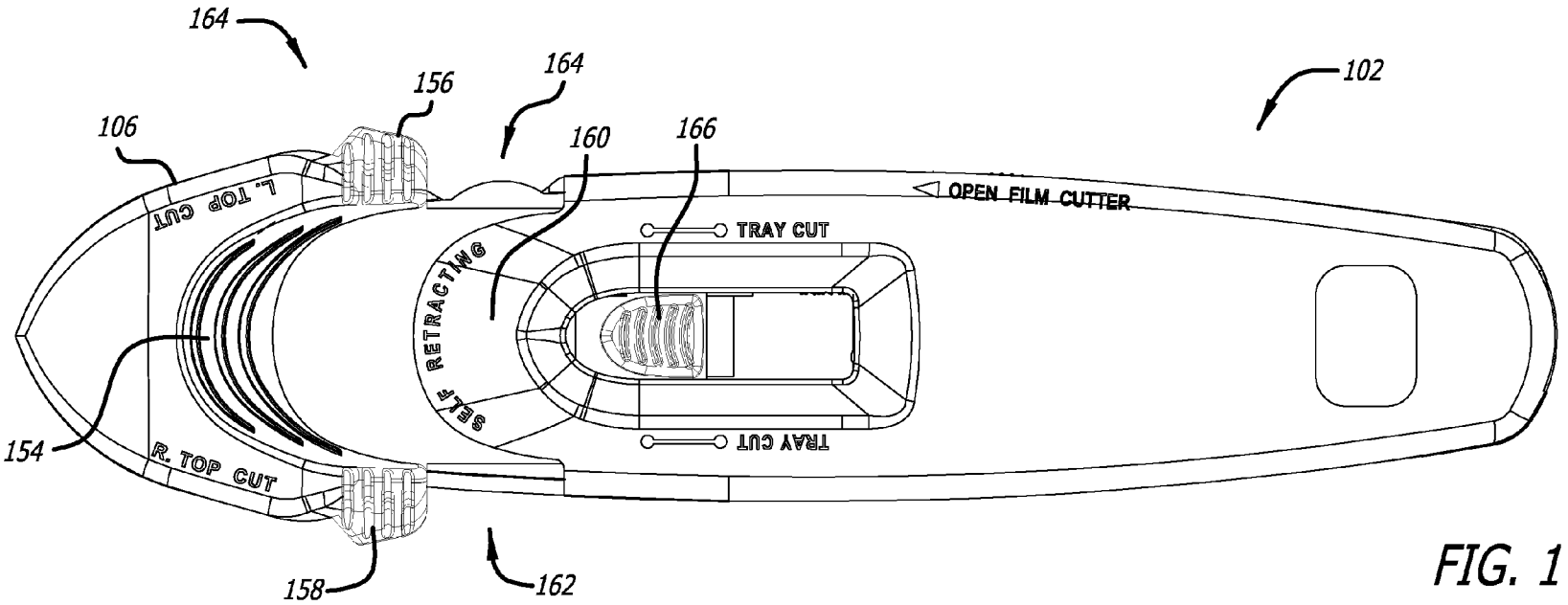
FIG. 1 is a top view of an example embodiment of a cutter apparatus.
Figure 2:
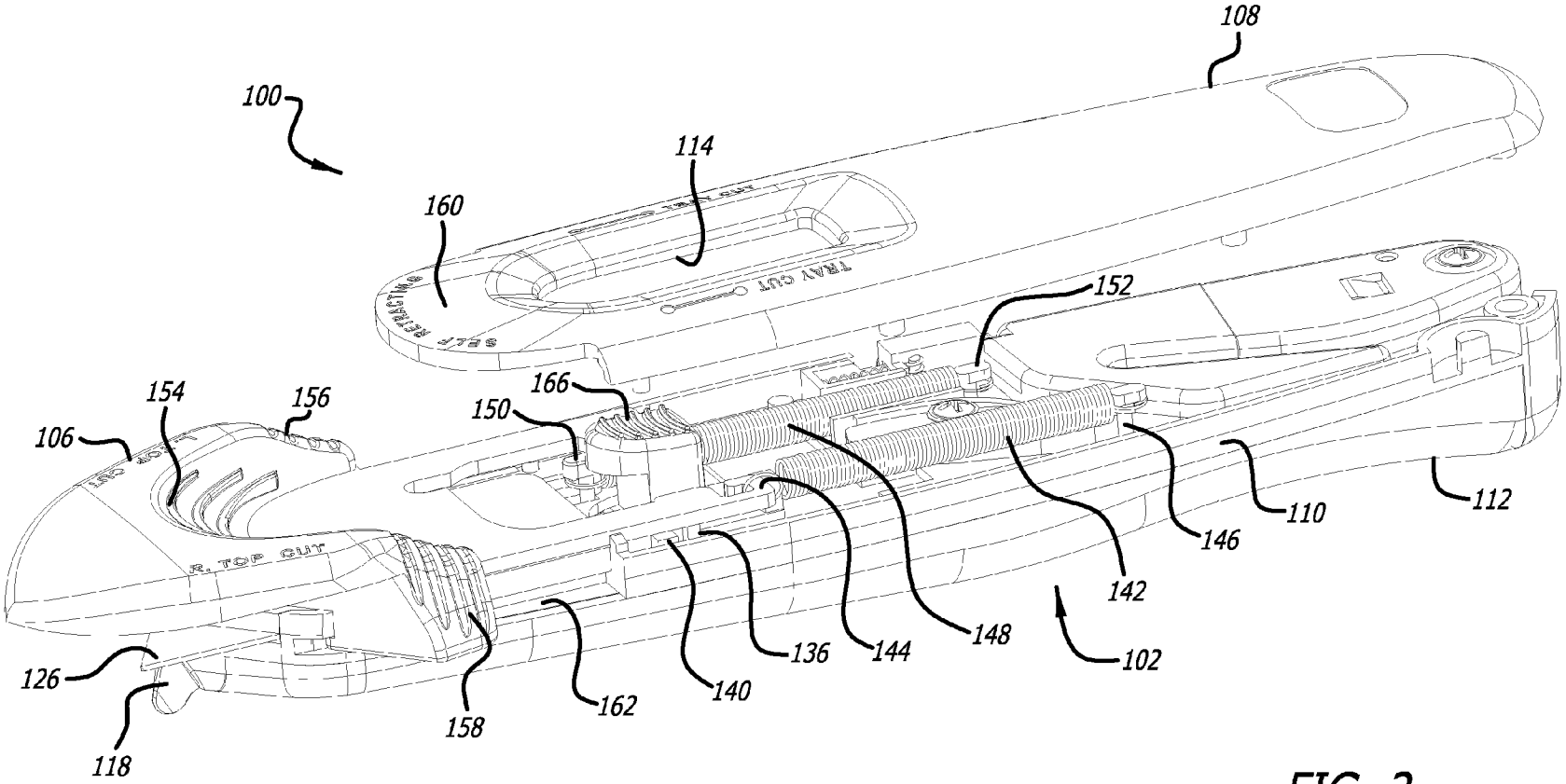
FIG. 2 is a perspective view of the cutter apparatus of FIG. 1, shown with its top portion separated from the main body portion, and its blade extended to a partially-extended position in response to its blade guard being pushed forward.
Figure 3:
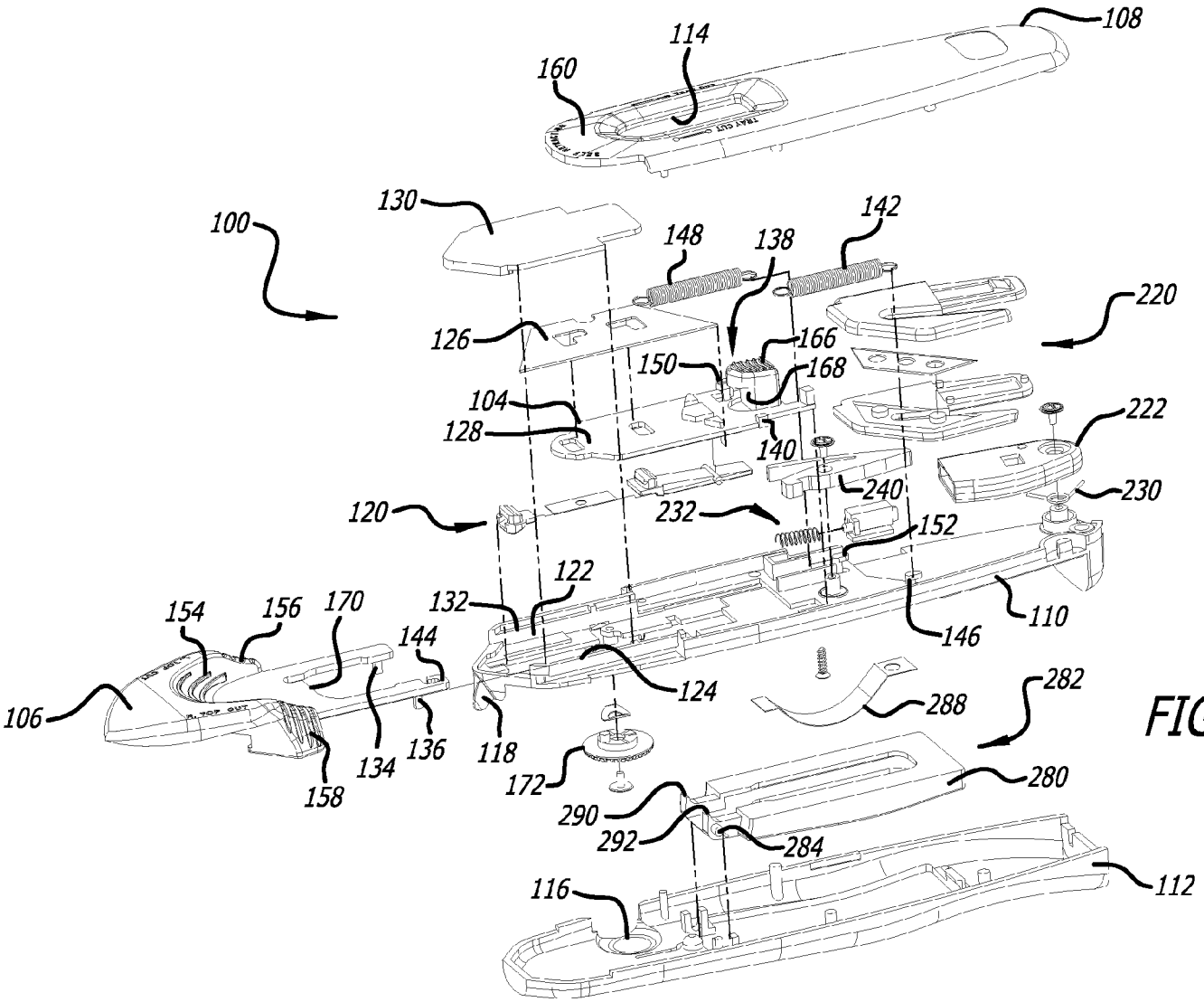
FIG. 3 is an exploded perspective view of the cutter apparatus of FIG. 1.

Referring to FIGS. 1-3, in an example embodiment, a cutter apparatus 100 includes a housing 102, a slider 104, and a blade guard 106 (which also functions as a cutting guide). In this example embodiment, the housing 102 includes an upper housing portion 108, a backbone structure 110, and a lower housing portion 112 formed as shown to facilitate being interfitted together during assembly. The upper housing portion 108 includes a slider window 114, and the lower housing portion 112 includes a dial window 116. The backbone structure 110, by way of example, can be formed from a rigid material such as zinc. In this example embodiment, the backbone structure 110 includes a tape splitter 118 shaped and positioned as shown adjacent to the blade guard 106.

A blade retention/release assembly 120 (discussed below in greater detail) is secured within the housing 102. The slider 104 is supported within the backbone structure 110 by channels 122, 124. A front blade 126 is supported by the top surface 128 of the slider 104. A cover plate 130 is supported at its forward end by surface 132 of the backbone structure 110. The blade guard 106, in turn, is positioned over the cover plate 130 and supported within the housing 102 such that the blade guard 106 can be slid longitudinally. In this example embodiment, the blade guard 106 includes follower posts 134, 136 which respectively make contact with surfaces 138, 140, of the slider 104 when the blade guard 106 is slid forward.

FIG. 2 illustrates the cutter apparatus 100 in operation with the front blade 126 being extended to a partially-extended ("top cut") position in response to the blade guard 106 being pushed forward. During this motion, force applied (by a user of the cutter apparatus 100) to the blade guard 106 overcomes a counterbias applied by a guard spring 142, which is secured as shown between a retention hook 144 (of the blade guard 106) and a post 146 (of the backbone structure 110). This force also must overcome a counterbias applied by a slider spring 148, which is secured as shown between a post 150 (of the slider 104) and a post 152 (of the backbone structure 110). In this example embodiment, the blade guard 106 and the slider 104 are independently spring biased.

Accordingly, FIG. 2 illustrates that in this example embodiment the slider 104 and the blade guard 106 are configured to move in tandem as the blade guard 106 is deployed. In an example embodiment, a cutter apparatus includes a housing shaped to be hand-held, a slider configured to support a front blade, the slider being mechanically coupled to the housing and configured to be moved longitudinally along the housing, and a blade guard mechanically coupled to the housing and configured to be extended and retracted adjacent to the front end of the housing, wherein the slider and the blade guard are configured to move in tandem.

The blade guard 106 includes one or more ergonomically designed surfaces or portions for pushing the blade guard 106 forward. In this example embodiment, the blade guard 106 includes a center grip portion 154 and two adjacent side grip portions 156, 158 formed as shown. In this example embodiment, the center grip portion 154 extends above a top surface 160 of the housing 102, and the side grip portions 156, 158 extend wider than the housing 102.

In operation, some users of the cutter apparatus 100 may find that the quickest and easiest way to deploy the front blade 126, e.g., to "top cut" a box, is to use their thumb to press the center grip portion 154 forward and hold it in that forward position during the cutting motion. When the user lets go of the blade guard 106, the blade guard 106 is retracted backward by the guard spring 142. This backward motion of the blade guard 106, in turn, releases the slider 104 to be retracted backward by the slider spring 148.

For extended intervals of cutting, some users of the cutter apparatus 100 may find it more comfortable to position a finger behind one or both of the side grip portions 156, 158. In this example embodiment, the housing 102 includes recesses 162, 164 which further enhance gripping comfort when using the side grip portions 156, 158, respectively.

Figure 4:
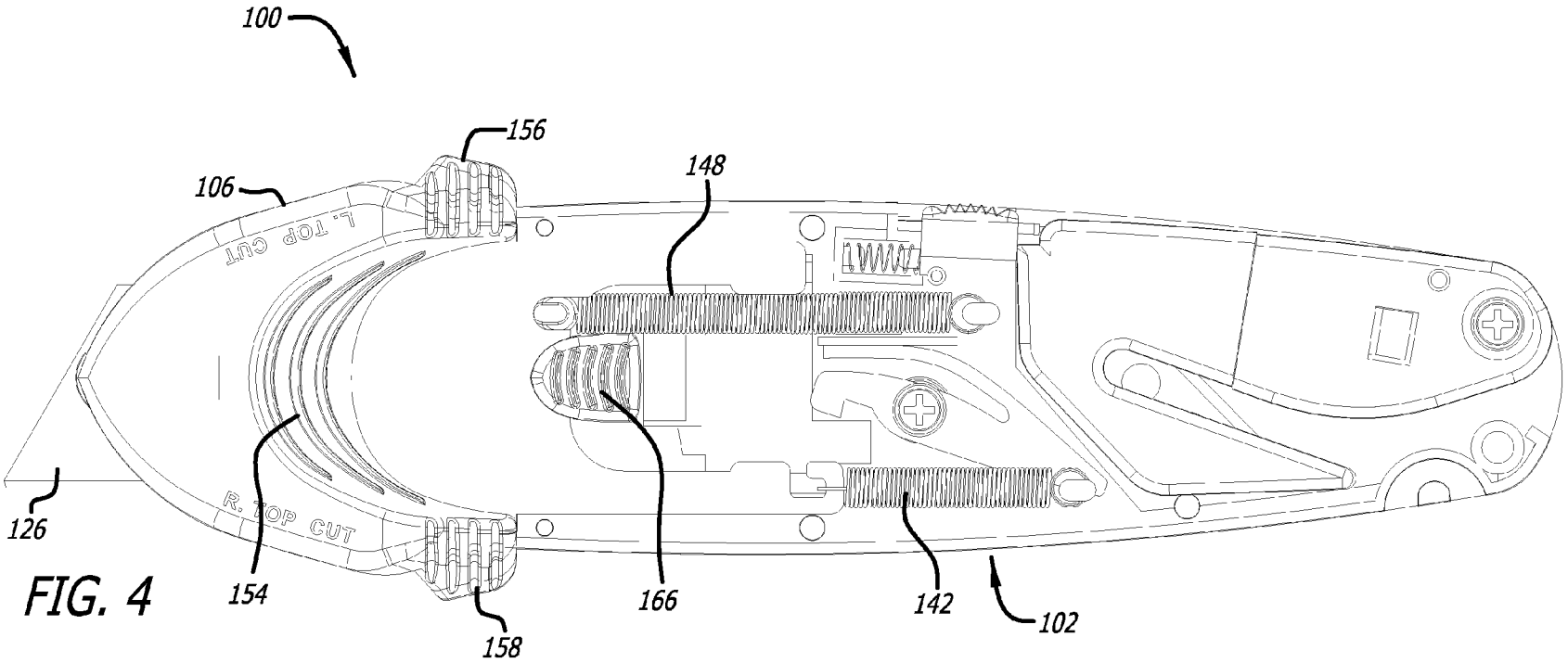
FIGS. 4 and 5 are top and perspective views, respectively, of the cutter apparatus of FIG. 1, shown with its top portion removed, and its blade extended to a fully-extended position in response to its button being pushed forward.
Figure 5:
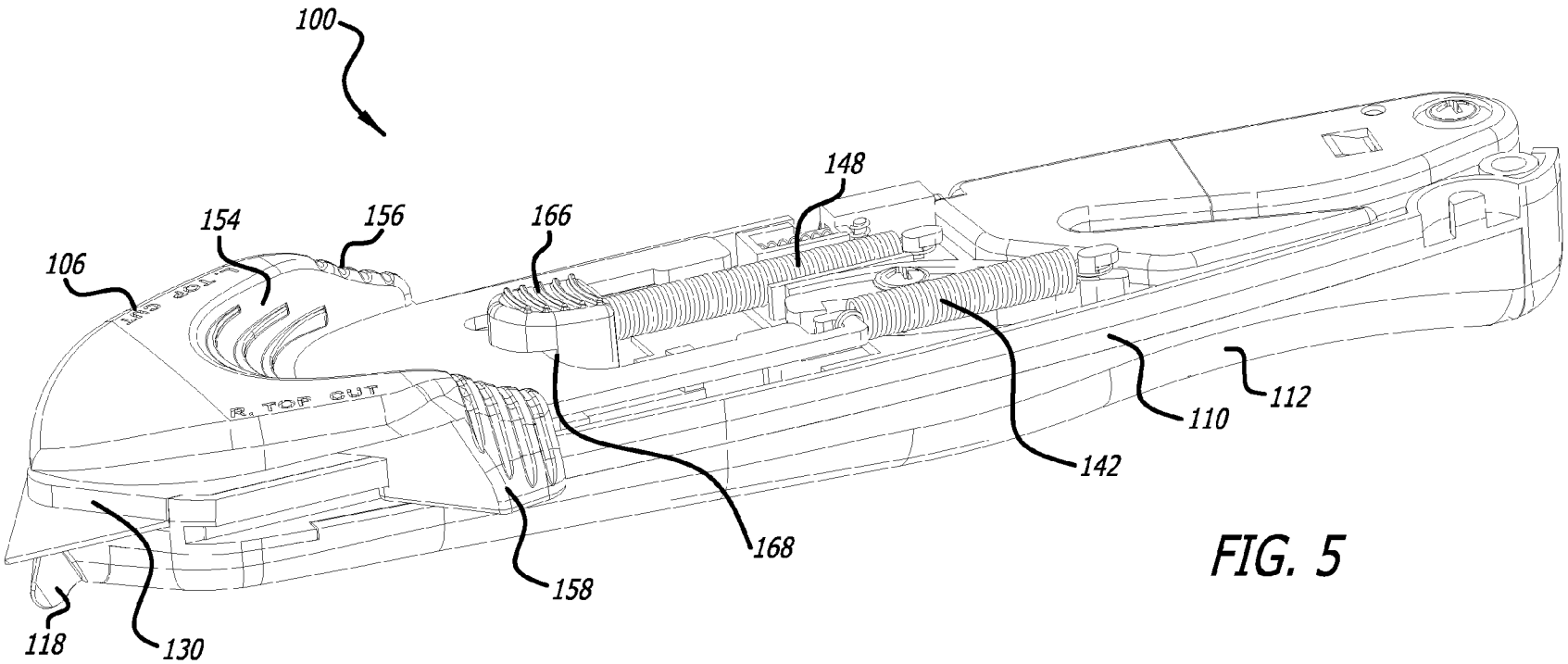

FIGS. 4 and 5 illustrate the cutter apparatus 100 in operation with the front blade 126 being extended to a fully-extended ("tray cut") position in response to the slider 104 being directly pushed forward. More specifically, when a button 166 of the slider 104 is pressed forward by a user of the cutter apparatus 100, this motion brings a post surface 168 (of the slider 104) into contact with a surface 170 (of the blade guard 106; see FIG. 3, also) which extends the blade guard 106 in tandem with extension of the slider 104. During this motion, force applied (by a user of the cutter apparatus 100) to the slider 104 overcomes a counterbias applied by the slider spring 148. This force also must overcome a counterbias applied by the guard spring 142.

Accordingly, FIGS. 4 and 5 illustrates that in this example embodiment the slider 104 and the blade guard 106 are configured to move in tandem as the slider 104 is deployed. Referring to FIG. 5, the side grip portions 156, 158 (of the blade guard 106) are shaped as shown to slide along complementary surfaces on the outside of the backbone structure 110.

Referring to FIGS. 6, 7 and 13A-13E, in this example embodiment, the cutter apparatus 100 includes a depth stop mechanism for controlling the extent to which and if the slider 104 can be pushed forward to extend the front blade 126 from the housing 102. In this example embodiment, the depth stop mechanism is dial-controlled and includes a dial 172 which is supported by the dial window 116 (FIG. 3). In this example embodiment, the dial 172 is mechanically coupled to the housing 102 and configured such that a protrusion (or dog) 174 on the back side of the dial 172 is selectively brought (by rotating the dial 172) into contact with a stop surface on the slider 104 depending upon a selected amount the front blade 126 is to be permitted to be extended from the housing 102.

Figure 13A:
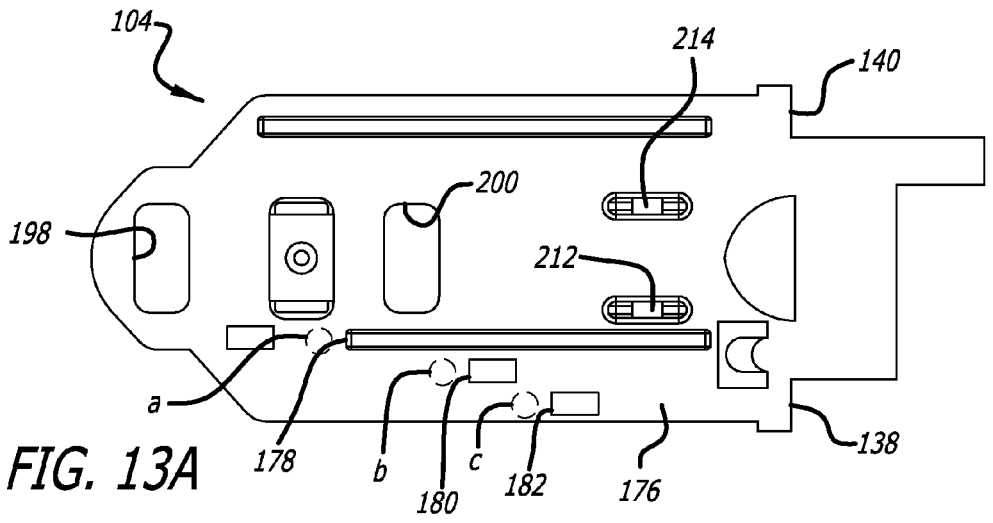
FIG. 13A-13E show the slider in bottom, side, top, end, and perspective views, respectively.
Figure 13B:
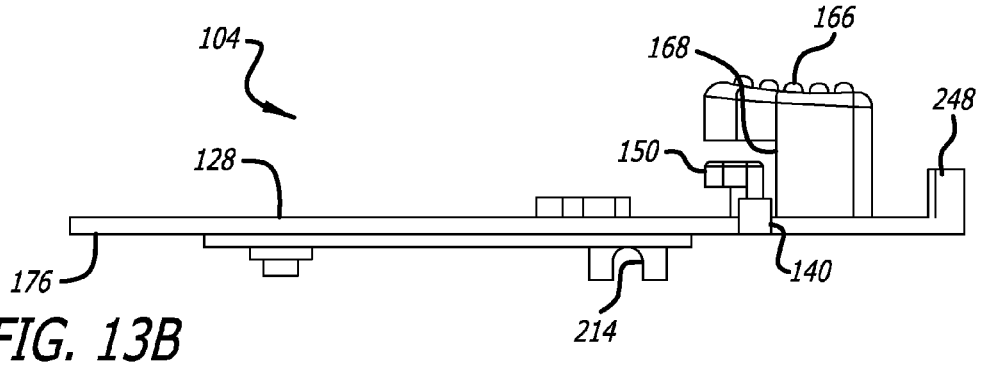
Figure 13C:
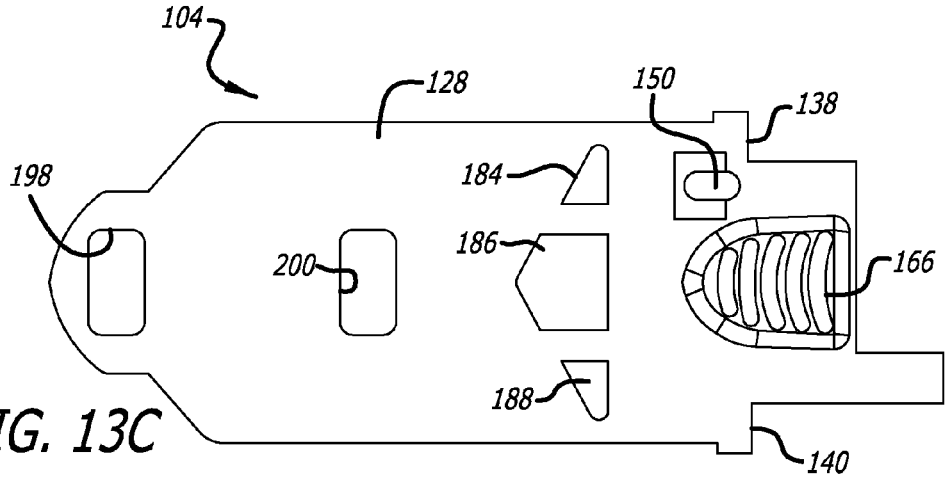
Figure 13D:
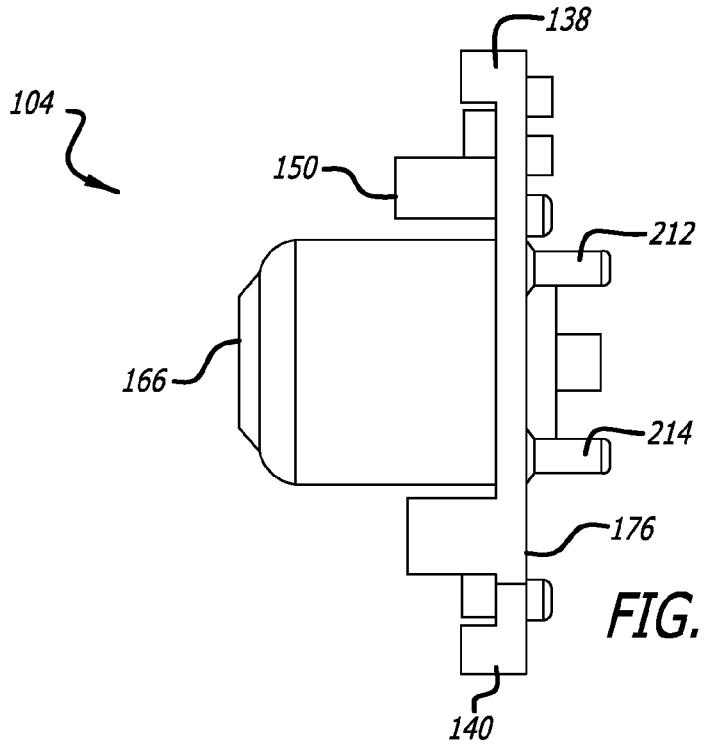
Figure 13E:
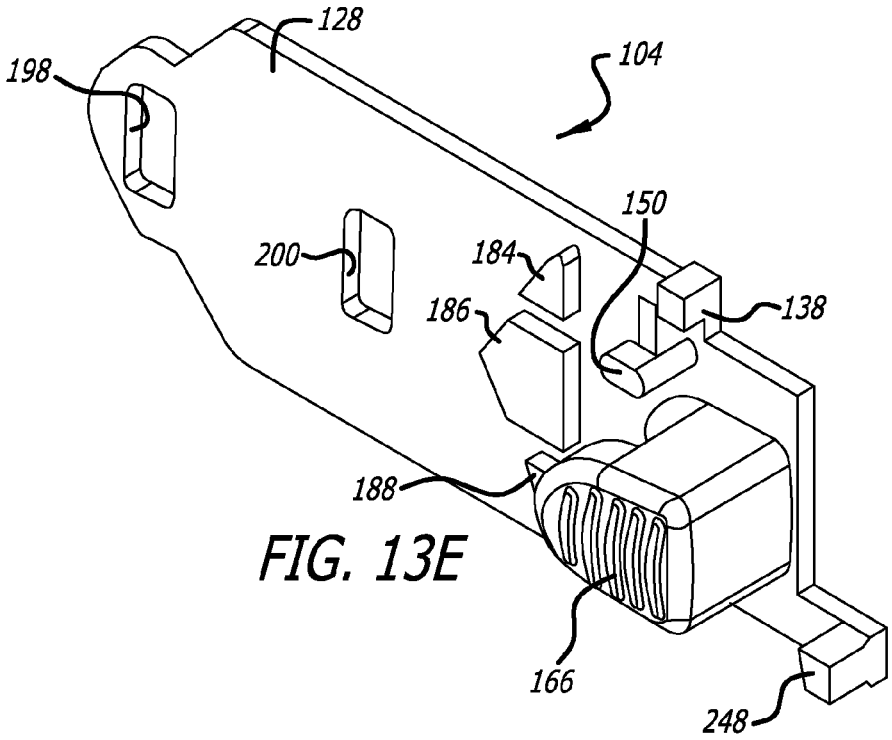

Referring FIG. 13A, in this example embodiment, a bottom surface 176 of the slider 104 includes a series of three stop surfaces 178, 180, and 182 formed as shown. The protrusion 174 is selectively brought into contact (at the locations denoted "a", "b", "c") with one of the stop surfaces 178, 180, and 182, respectively, depending upon whether the slider 104 is to be locked, permitted to move forward to a partially-extended blade position, or permitted to move forward to a fully-extended blade position.

It should be understood that alternative structures can be used to provide a depth stop mechanism for controlling the extent to which and if the slider 104 can be pushed forward. In an alternative embodiment, the depth stop mechanism has a different number of stops. In an alternative embodiment, the cutter apparatus 100 does not include a depth stop mechanism in the form of a dial. Independent of whether the cutter apparatus 100 includes a depth stop mechanism, either the slider 104 or the blade guard 106 can be repositioned to gradually extend the front blade 126 a specific amount depending upon the nature of the cutting task.

Figure 8:
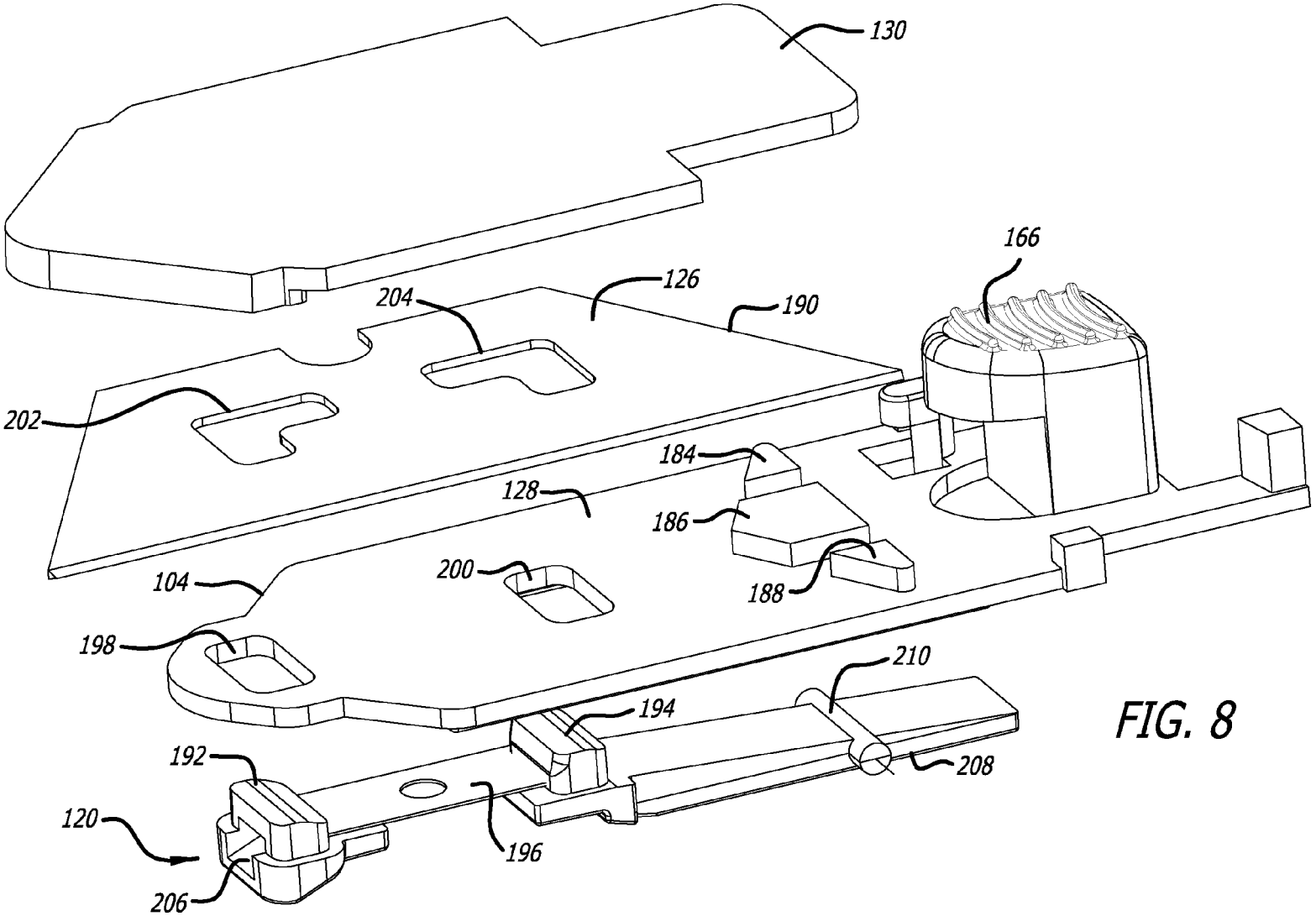
FIG. 8 is an exploded perspective view of the cover plate, blade, slider and blade retention/release assembly of the cutter apparatus of FIG. 1.

FIG. 8 is an exploded perspective view of the cover plate 130, front blade 126, slider 104 and blade retention/release assembly 120. Several features of the cutter apparatus 100 are now described with reference to this figure, namely, the ambidextrous nature of the slider 104 and the multi-stage blade release functionality provided by the slider 104 and the blade retention/release assembly 120 being manipulated in conjunction.

The slider 104 includes one or more symmetrical arranged support structures for the front blade 126. In this example embodiment, the one or more symmetrical arranged support structures include raised structures 184, 186, and 188 which are shaped and positioned as shown on the top surface 128 of the slider 104. In this example embodiment, the raised structures 184, 186, and 188 are generally V-shaped. More generally, the one or more symmetrical arranged support structures are configured such that at least one of the support structures faces an edge 190 of the front blade 126 when the blade is oriented for right-handed cutting, and at least one of the support structures faces the edge of the blade when the blade is oriented for left-handed cutting. It should be appreciated that an alternative support structure can be used to facilitate ambidextrous use of the cutter apparatus 100 in respect to cutting with the front blade 126.

With respect to the afore-mentioned multi-stage blade release functionality, the blade retention/release assembly 120 includes first and second blade retention/release tabs 192, 194 which are mechanically coupled together with a blade release spring 196 and sized to fit through complementary holes 198, 200 in the slider 104 and holes 202, 204 in the front blade 126. The first blade retention/release tab 192 including a ramp-shaped surface 206 which is brought into contact with a portion of the housing 102 when the slider 104 is advanced to its foremost position such that the first blade retention/release tab 192 is twisted away and withdrawn from the front blade 126 and the slider 104 (i.e., the first stage of the blade release process).

In this example embodiment, the blade retention/release assembly 120 further includes a tab portion 208 that is exposed through an opening in the housing 102, and a pivot member 210 that is pivotally secured at opposite ends thereof within recesses 212, 214 (FIG. 13A) which are located at the bottom surface 176 of the slider 104. The tab portion 208 is configured such that when the tab portion 208 is depressed, while the first blade retention/release tab 192 has already been disengaged from the front blade 126 and the slider 104, the tab portion 208 in turn disengages the second blade retention/release tab 194 from the front blade 126 and the slider 104, thereby releasing the front blade 126 to be withdrawn from the housing 102.

Figure 9:
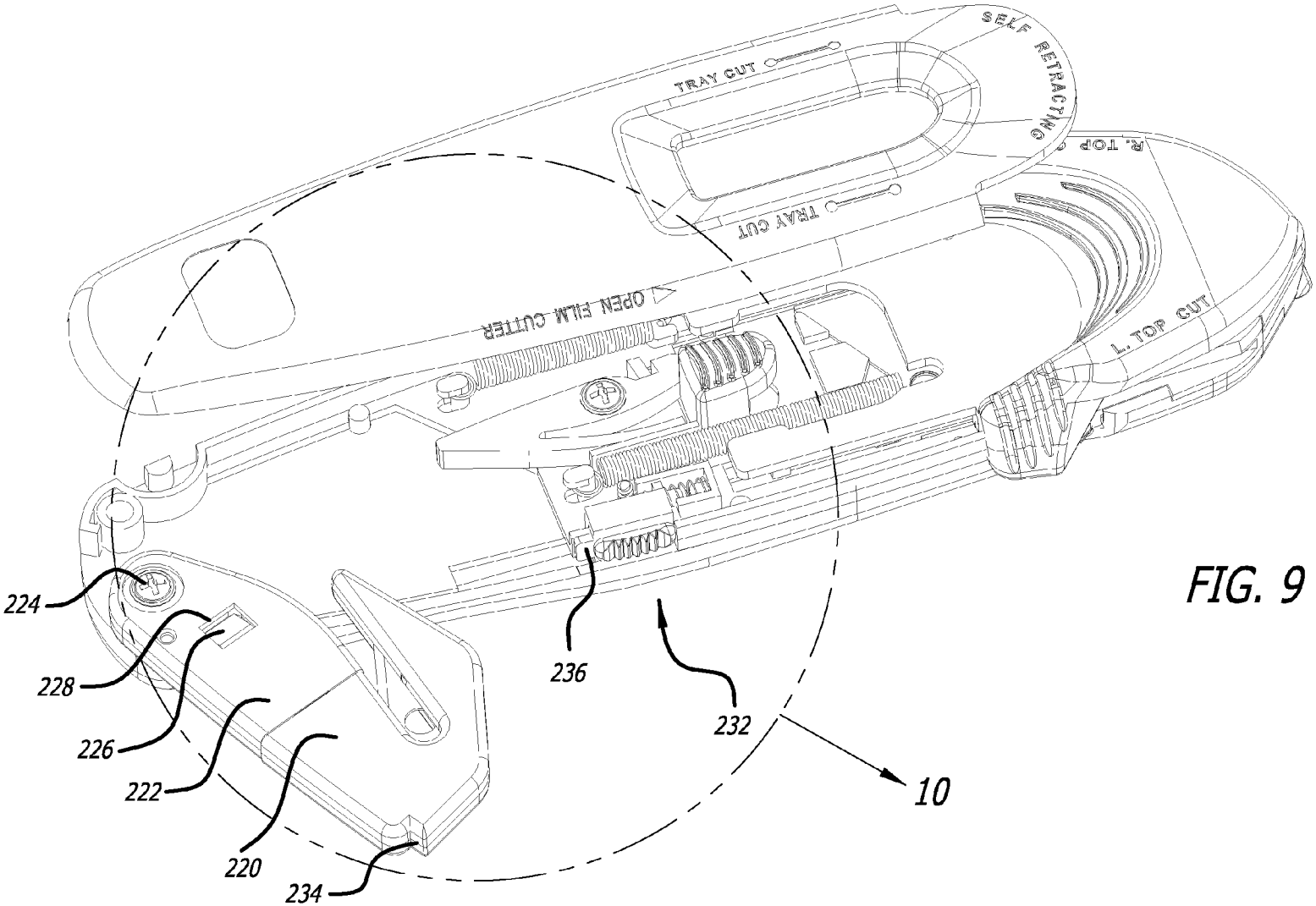
FIG. 9 is a perspective view of the cutter apparatus of FIG. 1, shown with its top portion separated from the main body portion, and its detachable film cutter partially deployed.
Figure 10:
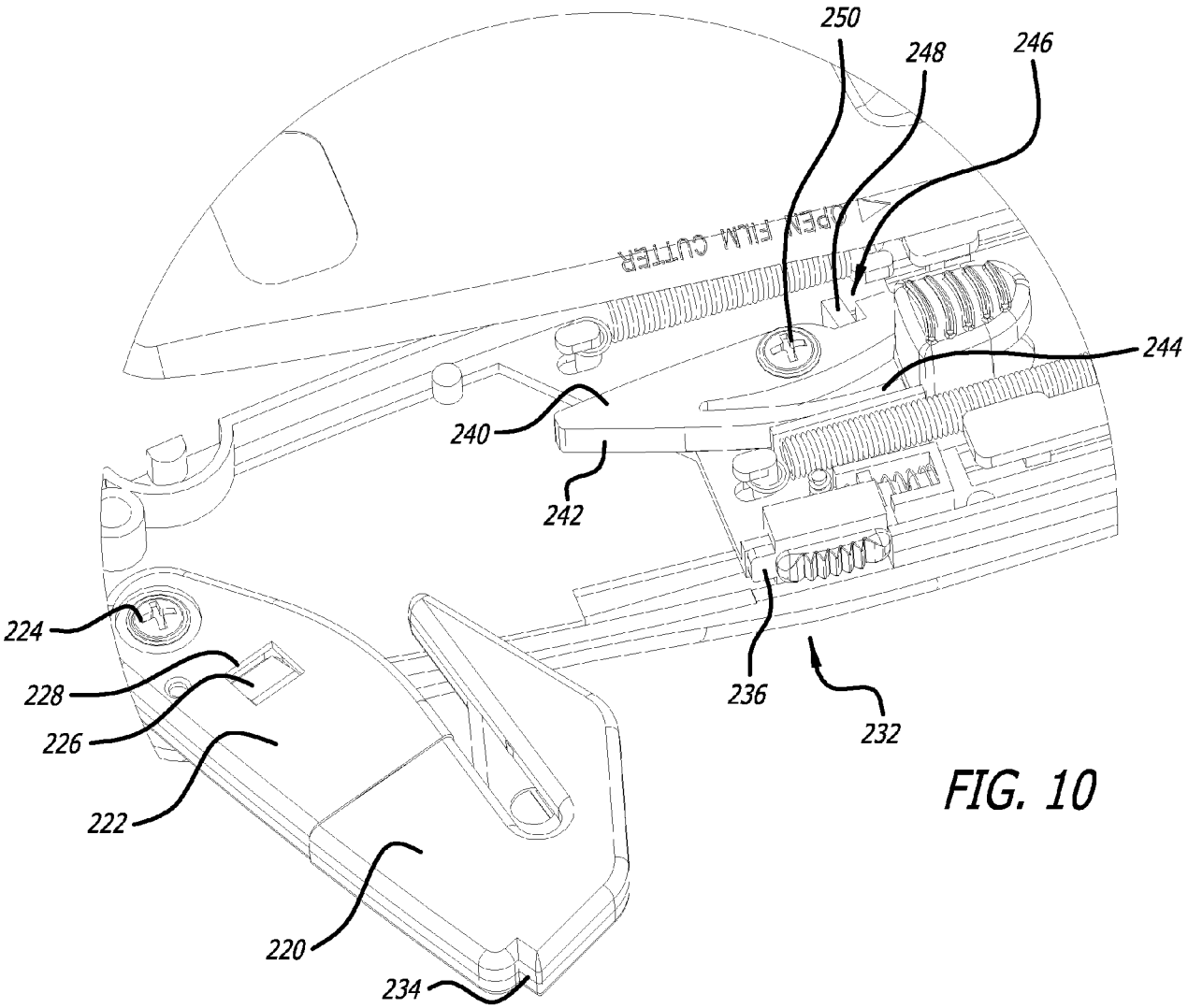
FIG. 10 is a perspective detail showing engagement of a front blade lockout mechanism when the detachable film cutter is deployed as shown in FIG. 9.

Referring to FIGS. 9 and 10, the cutter apparatus 100 also includes an auxiliary tool configured to be deployable from a back end of the housing 102. In this example embodiment, the auxiliary tool is a film cutter 220 which is detachably secured to an auxiliary tool receptacle 222 which is pivotally secured (by pivot axis 224) to the backbone structure 110. The film cutter 220 includes latch member 226 or the like which snap fits into a complementary recess 228 in the auxiliary tool receptacle 222.

In this example embodiment, the cutter apparatus 100 includes a coil spring 230 (FIG. 3) biased to deploy the auxiliary tool (e.g., the film cutter 220), and a tool latching/releasing device 232 configured to contact a complementary surface 234 of the auxiliary tool for securing the auxiliary tool within the housing and to be actuated by a user of the cutter apparatus to release the auxiliary tool. In this example embodiment, tool latching/releasing device 232 includes a tab 236 that is spring biased toward the complementary surface 234 to prevent the coil spring 230 from ejecting the auxiliary tool from the housing 102.

Figure 11:
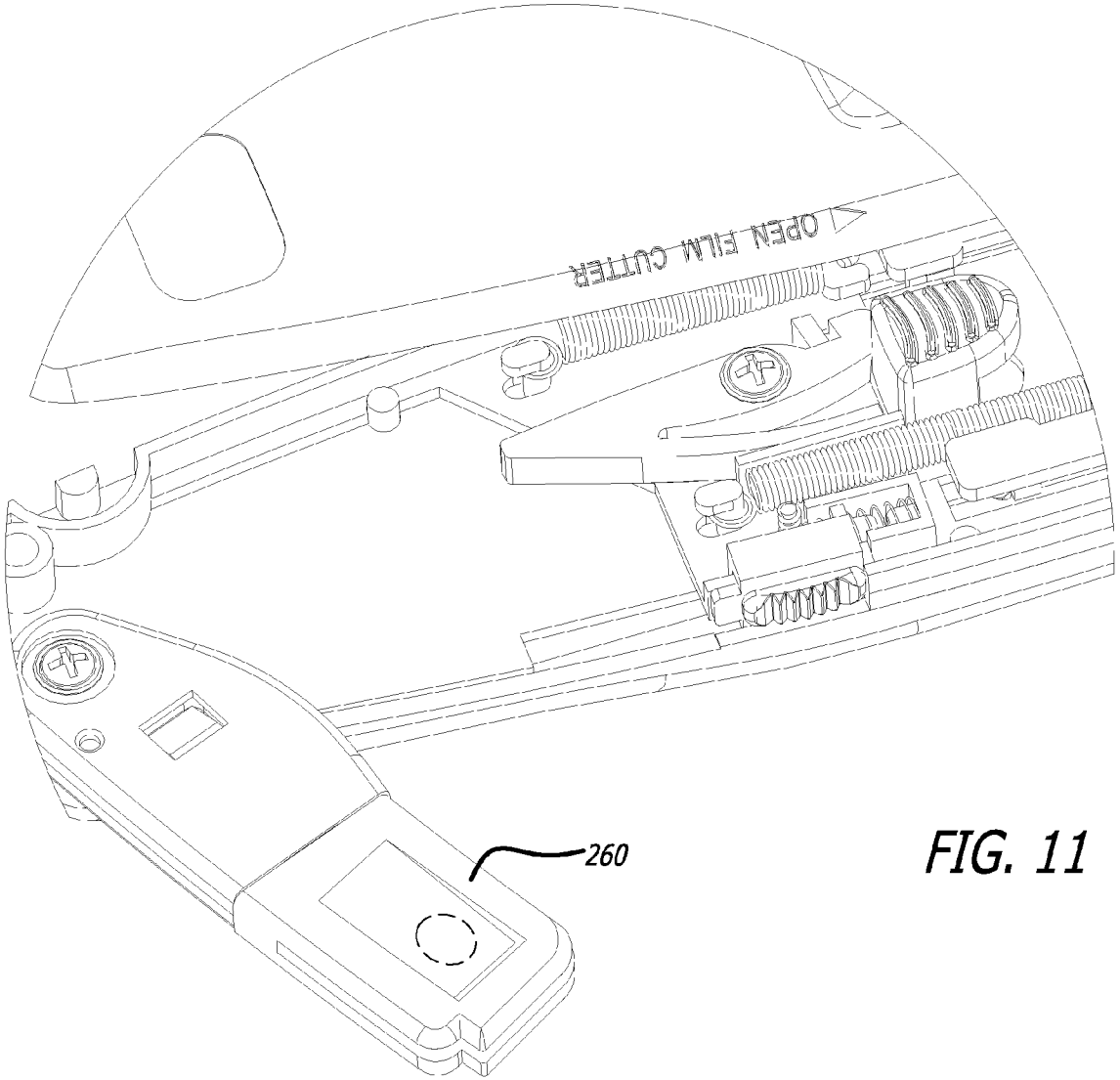
FIG. 11 is a perspective view of an alternate cutter apparatus as in FIG. 9, where the detachable film cutter is replaced with a detachable hole puncher.
Figure 12:
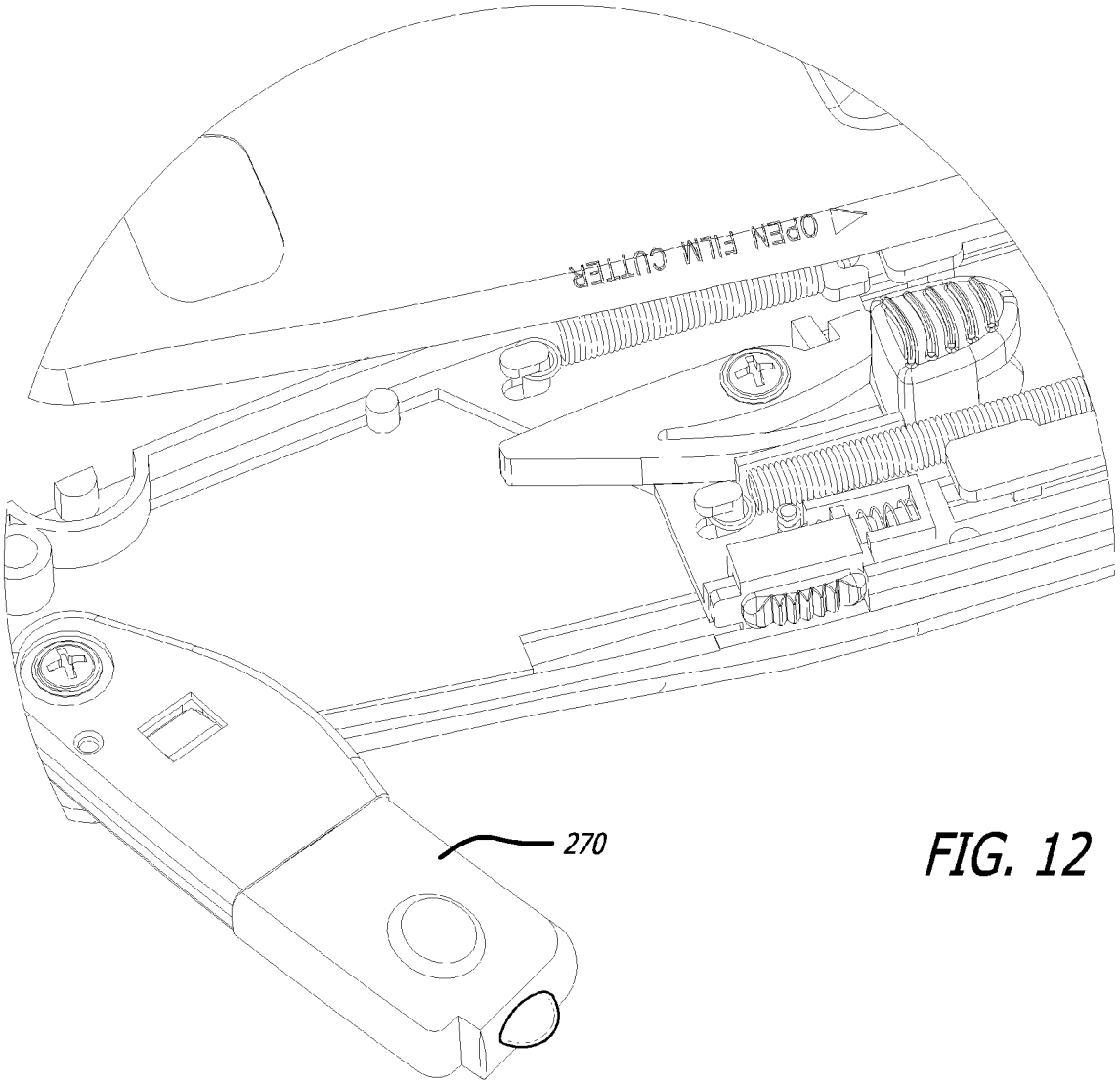
FIG. 12 is a perspective view of an alternate cutter apparatus as in FIG. 9, where the detachable film cutter is replaced with a detachable button-actuated light.

Referring to FIG. 10, in this example embodiment, the cutter apparatus 100 also includes an interlock device 240 that prevents the slider 104 from being moved to extend the front blade 126 from the housing 102 while the auxiliary tool is deployed. In this example embodiment, when the film cutter 220 is secured within the housing 102, the film cutter 220 contacts a surface 242 of the interlock device 240. When the film cutter 220 is released from the housing 102, a spring portion 244 of the interlock device 240 forces a notched portion 246 of the interlock device 240 to engage with an interlock hook 248 of the slider 104. In this example embodiment, the interlock device 240 is pivotally secured (by pivot axis 250) to the backbone structure 110. Thus, the interlock device 240 functions as a front blade lockout mechanism when the film cutter 220 or other auxiliary tool is deployed. Additional examples of auxiliary tools include a detachable hole puncher 260 (FIG. 11) and a detachable button-actuated light 270 (FIG. 12), such as a LED that is powered by a small battery located inside the auxiliary tool.

Figure 6:
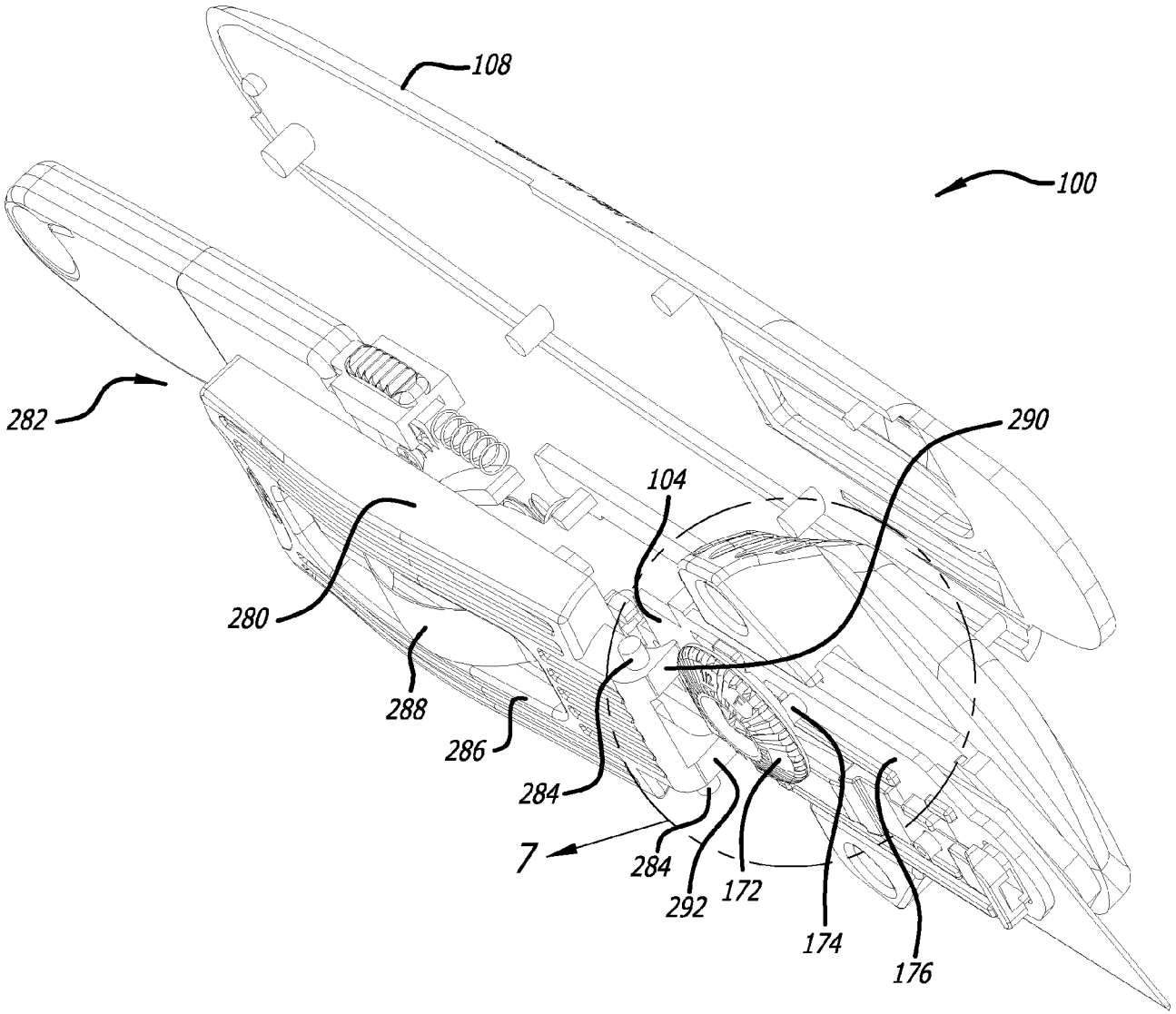
FIG. 6 is a partially exploded perspective view of the cutter apparatus of FIG. 1.
Figure 7:
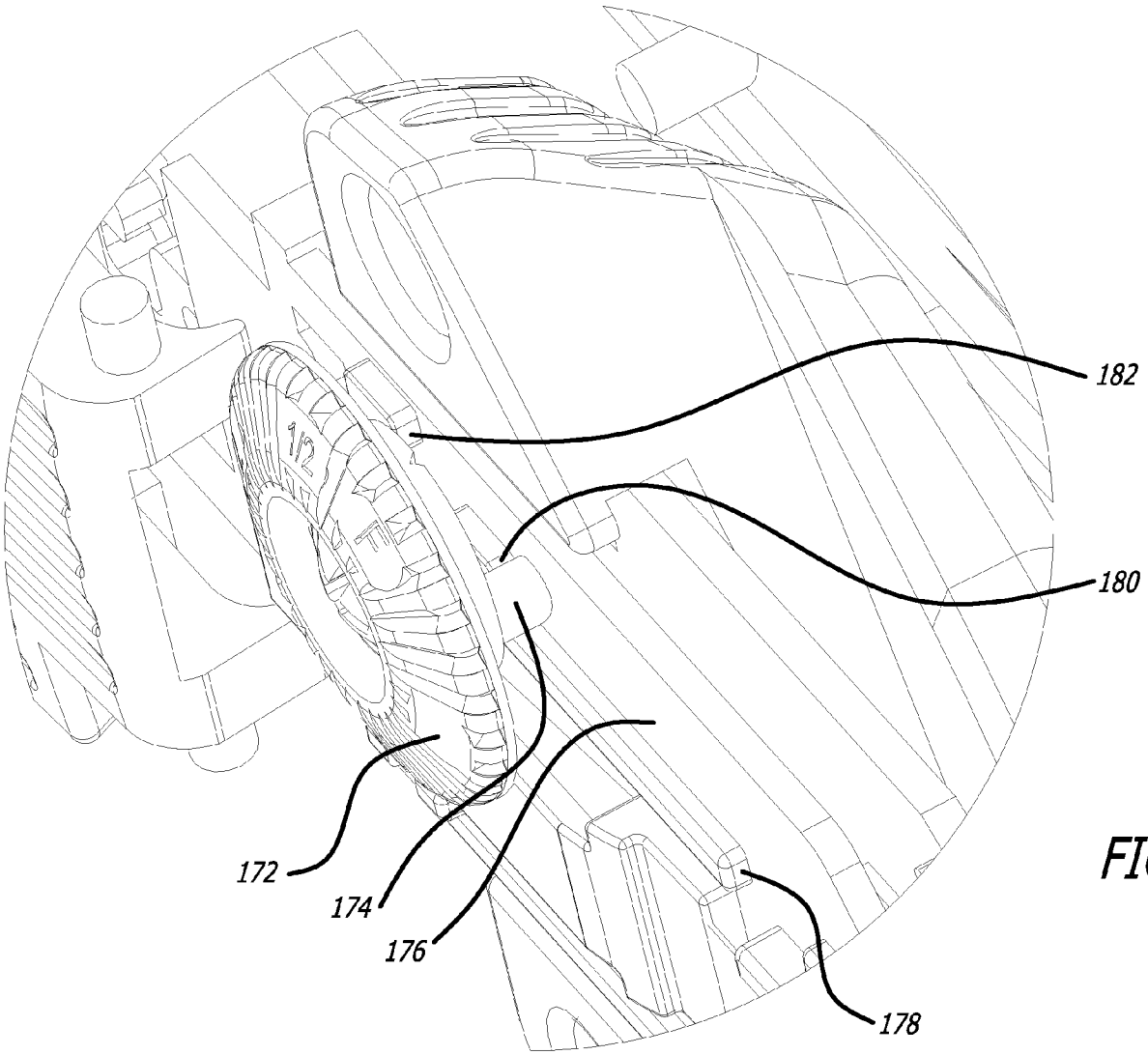
FIG. 7 is a perspective view showing the dial depth stop mechanism of FIG. 6 in detail.

Referring to FIGS. 3 and 6, in this example embodiment, the cutter apparatus 100 includes an enclosure 280 sized to hold spare blades (e.g., five spare blades). The enclosure 280 includes an end opening 282 for putting blades into and removing blades from the enclosure 280 and is pivotally secured as shown (via pivot axis 284) to the housing 102 and releasable from a secured position therein such that the end opening 282 is no longer positioned within the housing 102. The enclosure 280 includes a longitudinal window 286 for allowing a user to slide a spare blade out of the enclosure. In this example embodiment, the enclosure 280 is spring biased as shown by a spring 288 toward a spare blade dispensing position. In this example embodiment, the enclosure 280 is pivotally secured such that its range of pivoting motion is substantially limited (by contact of members 290, 292 with the slider 104) to only permit sufficient movement of the enclosure 280 to withdraw the end opening 282 from the housing 102.

Although the present invention has been described in terms of the example embodiments above, numerous modifications and/or additions to the above-described embodiments would be readily apparent to one skilled in the art. It is intended that the scope of the present invention extend to all such modifications and/or additions.

What is claimed is:

1. A cutter apparatus comprising:

a housing shaped to be hand-held;

a slider configured to support a front blade, the slider being supported within and repositionable along the housing;

a blade guard supported within the housing and configured to be extended and retracted adjacent to the front end of the housing;

an auxiliary tool configured to be deployable from a back end of the housing; and an auxiliary tool receptacle which is pivotally secured to and pivotally repositionable in relation to the housing to deploy the auxiliary tool, the auxiliary tool being detachably secured to the auxiliary tool receptacle;

wherein the auxiliary tool includes a latch member which snap fits into a complementary recess in the auxiliary tool receptacle, the latch when so engaged with the recess being accessible to a user of the cutter apparatus when the auxiliary tool is deployed but not accessible when the auxiliary tool is in its closed position secured within the housing.

2. The cutter apparatus of claim 1, wherein the slider and the blade guard are configured to move in tandem as the slider is deployed, the blade guard being contacted and pushed forward in response to the slider being pushed forward.

3. The cutter apparatus of claim 1, wherein the slider and the blade guard are configured to move in tandem as the blade guard is deployed, the slider being contacted and pushed forward to extend the front blade from the housing in response to the blade guard being pushed forward.

4. The cutter apparatus of claim 1, wherein the blade guard and the slider are independently spring biased.

5. The cutter apparatus of claim 1, wherein the blade guard includes a center grip portion and two adjacent side grip portions.

6. The cutter apparatus of claim 5, wherein the center grip portion extends above a top surface of the housing, and the side grip portions extend wider than the housing.

7. The cutter apparatus of claim 1, wherein the slider includes one or more symmetrical arranged support structures, at least one of which faces an edge of the blade when the blade is oriented for right-handed cutting, and at least one of which faces the edge of the blade when the blade is oriented for left-handed cutting.

8. The cutter apparatus of claim 7, wherein the one or more symmetrical arranged support structures are generally V-shaped.

9. The cutter apparatus of claim 1, wherein the slider includes stop surfaces, and the cutter apparatus further includes a dial mechanically coupled to the housing and configured such that a protrusion on the back side of the dial is selectively brought into contact with one of the stop surfaces depending upon a selected amount the front blade is to be permitted to be extended from the housing.

10. The cutter apparatus of claim 1, wherein the slider includes a series of three stop surfaces, and the cutter apparatus further includes a dial mechanically coupled to the housing and configured such that a protrusion on the back side of the dial is selectively brought into contact with one of the stop surfaces depending upon whether the slide is to be locked, permitted to move forward to a partially-extended blade position, or permitted to move forward to a fully-extended blade position.

11. The cutter apparatus of claim 1, wherein the cutter apparatus includes a coil spring biased to deploy the auxiliary tool, and a tool latching/releasing device configured to contact a complementary surface of the auxiliary tool for securing the auxiliary tool within the housing and to be actuated by a user of the cutter apparatus to release the auxiliary tool.

12. The cutter apparatus of claim 1, wherein the auxiliary tool is a film cutter.

13. The cutter apparatus of claim 1, wherein the auxiliary tool is a hole puncher.

14. The cutter apparatus of claim 1, wherein the auxiliary tool is a button-actuated light.

15. The cutter apparatus of claim 1, wherein the cutter apparatus includes an interlock device that prevents the slider from being moved to extend the front blade from the housing while the auxiliary tool is deployed.

16. The cutter apparatus of claim 1, wherein the cutter apparatus includes an enclosure sized to hold spare blades, the enclosure including an end opening for putting blades into and removing blades from the enclosure, the enclosure being pivotally secured to the housing and releasable from a secured position therein such that the end opening is no longer positioned within the housing, the enclosure including a longitudinal window for allowing a user to slide a spare blade out of the enclosure.

17. The cutter apparatus of claim 16, wherein the enclosure is spring biased toward a spare blade dispensing position.

18. The cutter apparatus of claim 16, wherein the enclosure is pivotally secured such that its range of pivoting motion is substantially limited to only permit sufficient movement of the enclosure to withdraw the end opening from the housing.

19. The cutter apparatus of claim 1, wherein the cutter apparatus includes a blade retention/release assembly configured to facilitate a multi-stage blade release operation.

20. The cutter apparatus of claim 19 wherein:

the blade retention/release assembly includes first and second blade retention/release tabs mechanically coupled together with a blade release spring and sized to fit through complementary holes in the slider and in the front blade, the first blade retention/release tab including a ramp-shaped surface which is brought into contact with a portion of the housing when the slider is advanced to its foremost position such that the first blade retention/release tab is twisted away and withdrawn from the front blade and the slider; and the blade retention/release assembly further includes a tab portion that is exposed through an opening in the housing, the tab portion being configured such that when the tab portion is depressed, while the first blade retention/release tab has already been disengaged from the front blade and the slider, the tab portion in turn disengages the second blade retention/release tab from the front blade and the slider, thereby releasing the front blade to be withdrawn from the housing.

21. The cutter apparatus of claim 1, wherein the cutter apparatus further includes a tape splitter protrusion located on a structurally rigid portion of the housing.

22. The cutter apparatus of claim 21, wherein the tape splitter protrusion is positioned adjacent to the blade guard.

* * * * *